US006023874A

United States Patent [19]

Veit

[11] Patent Number: 6,023,874

[45] Date of Patent: Feb. 15, 2000

[54] POINT AND SHOOT INDEX FINGER REST

[76] Inventor: John W. Veit, 1222 144th St. SE., Mill Creek, Wash. 98012

[21] Appl. No.: 09/131,634

[22] Filed: Aug. 1, 1998

Related U.S. Application Data

[60] Provisional application No. 60/056,716, Aug. 22, 1997.

[51] Int. Cl.[7] ..... F41C 3/14; F41C 27/00; F41A 4/62

[52] U.S. Cl. ..... 42/100; 42/94; 42/104

[58] Field of Search ..... 42/94, 104, 90, 42/98, 71.01, 71.02, 72, 100

[56] References Cited

U.S. PATENT DOCUMENTS

| | | | |
|---|---|---|---|
| Re. 20,456 | 7/1937 | McClarin, Sr. | 42/71.02 |
| D. 142,016 | 8/1945 | Birk | 42/71.02 |
| 694,969 | 3/1902 | Kemp | 42/71.02 |
| 792,077 | 6/1905 | Renwick | 42/71.02 |
| 896,099 | 8/1908 | Gardner | 42/100 |
| 897,577 | 9/1908 | Bourne | 42/94 |
| 898,178 | 9/1908 | Bourne | 42/100 |
| 946,210 | 1/1910 | Febiger | 42/71.02 |
| 1,298,920 | 4/1919 | Farago | 42/94 |
| 1,372,763 | 3/1921 | Marcq | 42/71.02 |
| 1,703,464 | 2/1929 | Wilshire | 42/104 |
| 2,109,993 | 3/1938 | Furst | 42/100 |
| 2,270,707 | 1/1942 | Humski | 42/100 |
| 2,320,450 | 6/1943 | Valenzuela | 42/71.02 |
| 2,436,175 | 2/1948 | Neal | 42/94 |
| 2,874,502 | 2/1959 | Lockwood | 42/71.02 |
| 3,156,059 | 11/1964 | Crain | 42/71.02 |
| 3,755,946 | 9/1973 | Tomlinson | 42/98 |
| 3,807,075 | 4/1974 | Mylonas | 42/104 |
| 3,934,768 | 1/1976 | Jones | 42/71.02 |
| 5,166,459 | 11/1992 | Stahle | 42/71.02 |
| 5,435,092 | 7/1995 | Brodie | 42/104 |
| 5,560,133 | 10/1996 | Kuebler | 42/69.01 |
| 5,873,189 | 2/1999 | Menke | 42/71.01 |

FOREIGN PATENT DOCUMENTS

| | | | |
|---|---|---|---|
| 650599 | 1/1929 | France | 42/104 |
| 312918 | 6/1919 | Germany | 42/98 |
| 11180 | 1/1852 | United Kingdom | 42/90 |
| 14093 | 5/1896 | United Kingdom | 42/104 |

*Primary Examiner*—Michael J. Carone
*Assistant Examiner*—Fredrick T. French, III

[57] ABSTRACT

An index finger rest for attachment to a firearm is disclosed. The index finger rest is attached to a firearm just above the trigger guard and in a surrounding relation thereto. The index finger rest being aligned with the barrel of the firearm. The finger rest has a horizontal and a vertical surface and the vertical surface being attached to the side of the firearm. The index finger can be placed against the finger rest and the firearm fired with the middle finger. The index finger rest of the present invention provides control and support to allow accurate point and shoot firing of a firearm. The finger rest is applicable to all types of hand held firearms, toy guns, air guns, pellet guns, paintball guns and archery devices.

3 Claims, 1 Drawing Sheet

SIDE VIEW OF GUN
WITH FINGER REST

END VIEW OF
FINGER REST

PERSPECTIVE VIEW OF
FINGER REST

SIDE VIEW OF GUN
WITH FINGER REST

END VIEW OF GUN
WITH FINGER REST

POINT AND SHOOT INDEX FINGER REST

This application claims benefit of Provisional Application No. 60/056,710 filed Aug. 22, 1997.

BACKGROUND OF THE INVENTION

This invention relates to aiming and shooting guns.

Films of actual police shootouts show that in close combat situations, most police do not aim carefully and then squeeze the trigger to shoot. They just point at or in the direction of a target and shoot rapidly. As such, accurate shooting is a matter of chance in those situations. And at night, when a sight can not be used, accurate shooting also is a matter of chance.

There is a method of aiming a gun that is automatic and accurate, and which can be used in close combat and at night. It utilizes our natural ability to point accurately. It can be called Point and Shoot or P&S. Here is how P&S works.

The index finger is placed against the side of a gun just above the trigger guard, and aligned with the barrel. The index finger is then pointed at a target, and the middle finger is used to pull the trigger.

P&S can be used with some sub-machine guns and assault rifles, but not with most pistols and revolvers. The shape of the upper rear portion of those guns does not allow the index finger to be placed above the trigger guard. A modified form of P&S can be used with them however. Here is how it works.

The index finger of the gun hand is placed against the side of the trigger guard, aligned with the barrel, and used to point at a target. The fingers of the other hand are wrapped around the fingers of the gun hand, and the index finger of the other hand is used to pull the trigger.

When P&S is used and a gun is fired, the index finger can move with each shot and may need to be realigned. It also may be hit with the slide of a pistol or be burned by powder flash. A shim may be needed on the side of a gun to allow alignment of the index finger with the barrel. And quick alignment of the index finger is not certain during combat or at night.

BRIEF SUMMARY OF THE INVENTION

Adding an index finger rest to a gun can provide a ready and reliable means for using P&S to automatically and accurately aim, and then shoot. The finger rest is added just above the trigger guard and aligned with the gun barrel. The index finger can be placed up and against it, pointed at a target, and the gun fired with the middle finger. The finger rest can be called a P&S index finger rest.

The improvement is applicable to all types and kinds of hand held firearms, toy guns, other types of guns such as air, pellet, paintball, etc., and some archery devices.

DETAILED DESCRIPTION OF THE INVENTION

Figure 1:
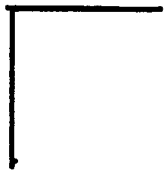
FIG. 1 is an end view of a P&S index finger rest configured as an attachment.
Figure 2:
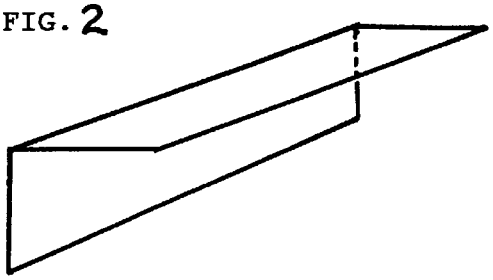
FIG. 2 is a perspective side view of a P&S index finger rest configured as an attachment. The four corners can be rounded.
Figure 3:
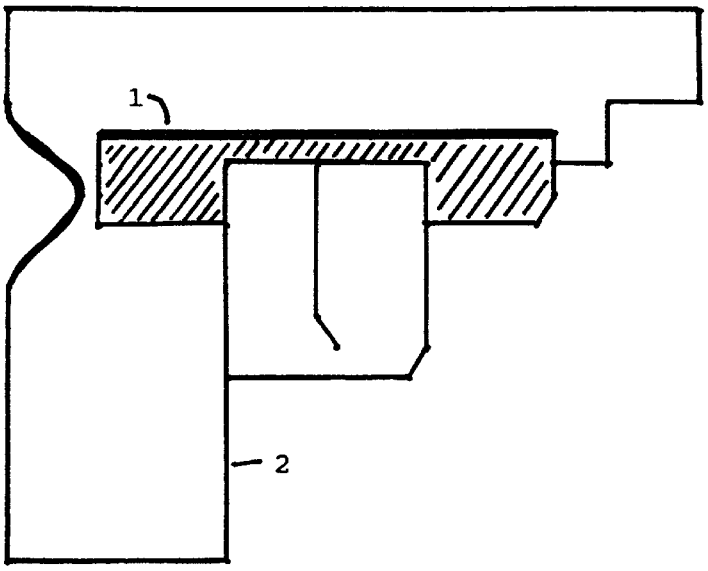
FIG. 3 is a side view of a P&S index finger rest configured as an attachment and attached to a gun. Portions of the horizontal part of the finger rest have been cut away to match the shape of the gun. The trigger guard and trigger are shown extended to accommodate using the middle finger to pull the trigger.
Figure 4:
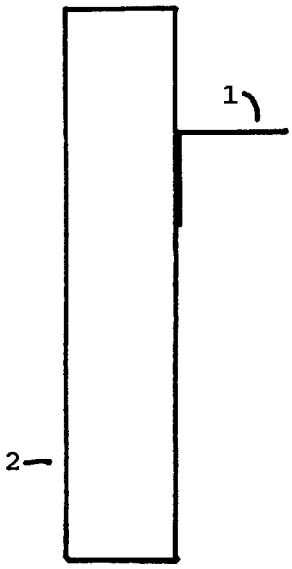
FIG. 4 is an end view of a P&S index finger rest configured as an attachment and attached to a gun.

Adding an index finger rest 1, to a gun 2, provides a ready and reliable means for using P&S to automatically and accurately aim, and then shoot.

The index finger rest 1, is about four inches long, positioned just above and about one inch in back of the trigger guard, aligned with the barrel, and has two flat surfaces each about ¾ of an inch wide, one that extends horizontally out from a point just above the trigger guard, and one that extends vertically down from the same point and which can be the side of the gun 2.

The placement of the index finger rest should insure that when the index finger is placed up and against it, the side of both the middle and root knuckle of the index finger make contact with the horizontal surface, and the palm side of the index finger makes contact with the vertical surface. Those contacts are critical to automatic and accurate aiming.

This improvement is applicable to all types and kinds of hand held firearms, toy guns, other types of guns such as air, pellet, paintball, etc., and some archery devices. The word weapon as used here, means all of them. The finger rest can be called a P&S index finger rest.

Besides allowing automatic and accurate aiming at any time, a P&S index finger rest provides improved weapon support because the weapon can be grasped and supported by both thumb and index finger.

A P&S index finger rest also shields the index finger from the slide of a pistol, and from powder flash.

It will start doing what it can do naturally and accurately, and that is point. As fast as one can point at a target, the weapon will be aimed at that target.

A P&S index finger rest also provides a flexible yet stable shooting platform. One can stay on target while moving. And the free hand can be cupped and used as a holder for the gun hand to give added support. Recoil can be absorbed better, and target re-acquisition will be quicker.

The sight still can be used to aim, and the index finger still can be used to pull the trigger.

P&S index finger rests can be incorporated into parts for new weapons or existing weapons, or they can be added to existing weapons. They can be added to one or both sides of weapons, and they can be added to the front grip if there is one. They can be made of metal, tough plastic, or any substantial material, and attached with screws, bolts, clips, mounting pins, glue, weld, or by the use of spring loaded pins that fit into mounts, etc. They can fold up and down, have custom made molded inserts that can be attached to them by a variety of means, etc.

An extended trigger guard and trigger will be needed in most applications to allow the middle finger to pull the trigger. That will not be necessary in pistol and revolver applications if the alternate method of P&S as described above, will be used. Also, no change to the gun action is needed.

I claim:

1. An index finger rest for attachment to a firearm comprising:

a horizontal surface and a vertical surface, and the vertical surface being perpendicular to the horizontal surface;

the horizontal surface and the vertical surface being generally rectangular and planar;

the vertical surface being attachable to the firearm above a trigger guard of the firearm, said vertical surface having an opening therein, said opening generally conforming to the trigger guard of the firearm, wherein at least a portion of said vertical surface extends below an upper portion of said trigger guard;

the horizontal surface extending a distance away from the side of the firearm;

wherein an index finger engages the horizontal surface from below and the vertical surface of the index finger rest providing control and support for the firearm during firing.

2. An index finger rest for attachment to a firearm according to claim 1, wherein the horizontal and vertical surfaces having a length of about 4 inches and a width of about ¾ inches.

3. An index finger rest for attachment to a firearm according to claim 1, wherein the index finger rest is attachable to the firearm through adhesive means.

* * * * *